US008670698B2

(12) United States Patent
Park

(10) Patent No.: US 8,670,698 B2
(45) Date of Patent: Mar. 11, 2014

(54) DEVELOPMENT DEVICE HAVING A REGULATION PORTION AND IMAGE FORMING APPARATUS INCLUDING DEVELOPMENT DEVICE

(75) Inventor: Jong-hyun Park, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 164 days.

(21) Appl. No.: 13/067,489

(22) Filed: Jun. 3, 2011

(65) Prior Publication Data

US 2012/0039638 A1 Feb. 16, 2012

(30) Foreign Application Priority Data

Aug. 11, 2010 (KR) ..... 10-2010-0077498

(51) Int. Cl.
*G03G 15/09* (2006.01)

(52) U.S. Cl.
USPC ..... 399/274

(58) Field of Classification Search
USPC ..... 399/274, 284
See application file for complete search history.

(56) References Cited

U.S. PATENT DOCUMENTS

| | | | |
|---|---|---|---|
| 5,583,622 | A | 12/1996 | Nishimura |
| 5,758,241 | A | 5/1998 | Oyama et al. |
| 6,321,056 | B1 | 11/2001 | Takami |
| 7,171,145 | B2 | 1/2007 | Takeuchi et al. |
| 7,289,755 | B2 | 10/2007 | Terai |
| 7,406,280 | B2 | 7/2008 | Tomita et al. |
| 7,515,856 | B2 | 4/2009 | Ohyama |
| 7,620,351 | B2 | 11/2009 | Onda et al. |

FOREIGN PATENT DOCUMENTS

| | | | | |
|---|---|---|---|---|
| JP | 62-116975 | | | 5/1987 |
| JP | 62-135863 | | | 6/1987 |
| JP | 03095579 | A | * | 4/1991 |
| JP | 05053436 | A | * | 3/1993 |
| JP | 07044018 | A | * | 2/1995 |
| JP | 11327305 | A | * | 11/1999 |
| JP | 2000-227721 | | | 8/2000 |
| JP | 2001265097 | A | * | 9/2001 |
| JP | 2004-302250 | | | 10/2004 |

(Continued)

OTHER PUBLICATIONS

European Search Report dated Dec. 29, 2011 issued in corresponding European Patent Application No. 11167928.8.

(Continued)

*Primary Examiner* — Walter L Lindsay, Jr.
*Assistant Examiner* — Milton Gonzalez
(74) *Attorney, Agent, or Firm* — Staas & Halsey LLP

(57) ABSTRACT

A development device using a developing agent including a toner and a carrier, in which the development device includes a development roller that attaches the developing agent to a circumference surface of the development roller and transfers the developing agent to a development region in which the development roller faces a photo receptor; and a regulation portion to regulate an amount of the developing agent transferred to the development region, where the regulation portion includes first, second, and third regulation portions sequentially disposed in the stated order in an opposite direction to a rotational direction of the development roller, where the first, second, and third regulation portions are respectively spaced apart from the circumference surface of the development roller by first, second, and third intervals, the second interval is greater than the third interval, and the third interval is narrowed in the rotational direction of the development roller.

23 Claims, 6 Drawing Sheets

(56) References Cited

FOREIGN PATENT DOCUMENTS

| | | |
|---|---|---|
| JP | 2005-84434 | 3/2005 |
| JP | 2005-107475 | 4/2005 |
| JP | 2005-215049 | 8/2005 |
| JP | 2006-58667 | 3/2006 |
| JP | 2007-127944 | 5/2007 |

OTHER PUBLICATIONS

European Office Action mailed May 3, 2013 in corresponding European Application No. 13157799.1.

* cited by examiner

DEVELOPMENT DEVICE HAVING A REGULATION PORTION AND IMAGE FORMING APPARATUS INCLUDING DEVELOPMENT DEVICE

CROSS-REFERENCE TO RELATED APPLICATIONS

This application claims the benefit of Korean Patent Application No. 10-2010-0077498, filed on Aug. 11, 2010, in the Korean Intellectual Property Office, the disclosure of which is incorporated herein in its entirety by reference.

BACKGROUND

1. Field

The present general inventive concept relates to a development device that is separable from an image forming apparatus and an image forming apparatus including the development device.

2. Description of the Related Art

An electrophotographic image forming apparatus operates as follows: light modified according to image information is irradiated to a photo receptor to form a latent image on a surface of the photo receptor, toner is supplied to the latent image to develop the latent image into a visible toner image, the visible toner image is transferred to a recording medium, and the transferred image is fixed, thereby printing an image on the recording medium.

An electrophotographic image forming apparatus includes a development device including a developing agent. A one-component development device includes a toner as a developing agent, and a two-component development device includes a toner and a carrier as a developing agent. When the developing agent included in the development device is completely consumed, the used development device is separated from an electrophotographic image forming apparatus and a new development device is mounted on the electrophotographic image forming apparatus.

SUMMARY

In regard to an image forming apparatus using a two-component development method, a developing agent is attached to a surface of a development roller and is delivered to a development region in which a photo receptor faces the development roller, and only toner is supplied to a surface of the photo receptor. In this regard, a thickness of a layer of the developing agent supplied to the development region while being attached to the surface of the development roller is regulated by a regulation member.

The present general inventive concept provides a development device capable of uniformly regulating a thickness of a developing agent layer, and an image forming apparatus including the development device.

According to an aspect, there is provided a development device using a developing agent including a toner and a carrier, in which the development device includes a development roller that attaches the developing agent to a circumference surface of the development roller and transfers the developing agent to a development region in which the development roller faces a photo receptor; and a regulation portion to regulate an amount of the developing agent transferred to the development region, wherein the regulation portion includes first, second, and third regulation portions sequentially disposed in the stated order in an opposite direction to a rotational direction of the development roller, wherein the first, second, and third regulation portions are respectively spaced apart from the circumference surface of the development roller by first, second, and third intervals, the second interval is greater than the third interval, and the third interval is narrowed in the rotational direction of the development roller.

The second regulation portion may form a circulation space to allow the developing agent blocked by the first regulation portion to be discharged from the regulation portion through the third regulation portion outside the regulation portion.

The second regulation portion may be connected to the third regulation portion by a connection portion that is spaced from the circumference surface of the development roller by an interval that is narrowed toward the third regulation portion. The connection portion may be an inclination portion. The connection portion may be a curved portion that is concave toward the circumference surface of the development roller. The second regulation portion and the connection portion may be a curved portion that is concave toward the circumference surface of the development roller.

Where A is an interval between a front end portion of the third regulation portion in the rotational direction of the development roller and the circumference surface of the development roller, B is an interval between a back end portion of the third regulation portion in the rotational direction of the development roller and the circumference surface of the development roller, and C is the second interval, the following ranges may apply: $A>B$ and $C>B$, $2\ mm \le A \le 8\ mm$, $0.5\ mm \le B \le 4\ mm$, and $1\ mm \le C \le 7\ mm$.

The development device may further include a supply unit including at least one member to supply the developing agent to the development roller; and a developing agent guide member that has an end spaced apart from the third regulation portion and extends from the end over a member of the supply unit closest to the development roller among the members of the supply unit. The development roller may include a development sleeve that is rotatable and a magnetic roller that is fixedly disposed inside the development sleeve, wherein the magnetic roller includes a catch pole that attaches the developing agent to the development sleeve, and the end of the developing agent guide member may be disposed farther from the third regulation portion than a line passing a center of the development roller and the catch pole. The developing agent guide member may extend over a center of the member of the supply unit closest to the development roller among the members of the supply unit.

A magnetic member may be disposed between the first regulation portion and the second regulation portion and apply a magnetic load to a developing agent layer formed on the circumference surface of the development roller.

According to another aspect, there is provided a development device including: a development sleeve that is rotatable; a magnetic roller that is fixedly disposed inside the development sleeve and forms a developing agent layer including a carrier and a toner in a magnetic brush shape on a circumference surface of the development sleeve; a doctor blade having an end that is spaced apart from the circumference surface of the development sleeve by a first interval, thereby forming a first regulation portion; and a sub blade that is disposed prior to the doctor blade in a rotational direction of the development sleeve; wherein the sub blade includes a first surface that is spaced apart from the circumference surface of the development sleeve by a second interval that is greater than the first interval, thereby forming a circulation space for a developing agent that does not pass the first interval, and a second surface that is spaced apart from the circumference surface of the development sleeve by a third interval that is smaller than the second interval, thereby forming a passage for the developing agent supplied to the circulation space and the developing agent discharged from the circulation space.

The development device may further include a supply unit including at least one member for supplying the developing agent to the development sleeve, wherein the sub blade may include a developing agent guide member that has an end spaced apart from a front end portion of the second surface in the rotational direction of the development sleeve so as to allow the developing agent discharged through the passage for the developing agent to pass therethrough and extends from the end over the supply unit so that the developing agent discharged through the passage for the developing agent is collected by the supply unit.

The magnetic roller may include a catch pole that attaches the developing agent to the development sleeve, wherein the end of the developing agent guide member may be disposed farther from the front end portion of the second surface in the rotational direction of the development sleeve than a line passing a center of the development sleeve and the catch pole and the developing agent guide member may extend over a center of a member of the supply unit closest to the development sleeve among members of the supply unit.

The first surface may be connected to the second surface by a connection portion that is spaced apart from the development sleeve by an interval that is gradually narrowed. An interval between the second surface and the circumference surface of the development sleeve may be gradually narrowed in the rotational direction of the development sleeve.

Where A is an interval between the front end portion of the second surface in the rotational direction of the development sleeve and the circumference surface of the development sleeve, B is an interval between a back end portion of the second surface in the rotational direction of the development sleeve and the circumference surface of the development sleeve, and C is the second interval, the following ranges may apply: A>B, C>B, 2 mm≤A≤8 mm, 0.5 mm≤B≤4 mm, and 1 mm≤C≤7 mm.

According to another aspect, there is provided a development device including: a development sleeve that is rotatable; a magnetic roller that is fixedly disposed inside the development, sleeve and forms a developing agent layer including a carrier and a toner in a magnetic brush-shape on a circumference surface of the development sleeve; and a regulation portion that is spaced apart from the circumference surface of the development sleeve and regulates a thickness of a developing agent layer attached to the circumference surface of the development sleeve, wherein the regulation portion includes first, second, and third regulation portions sequentially disposed in the stated order in an opposite direction to a rotational direction of the development sleeve, wherein the first regulation portion forms a first developing agent pressure, the second regulation portion forms a second developing agent pressure that is smaller than the first developing agent pressure, and the third regulation portion forms a third developing agent pressure that is greater than the second developing agent pressure.

The second regulation portion may form a circulation space to allow a developing agent blocked by the first regulation portion to be discharged from the regulation portion through the third regulation portion.

The third developing agent pressure may be gradually increased in the rotational direction of the development sleeve.

An interval between the third regulation portion and the circumference surface of the development sleeve may be gradually decreased in the rotational direction of the development sleeve, an interval between the second regulation portion and the circumference surface of the development sleeve may be greater than the interval between the third regulation portion and the circumference surface of the development sleeve, and the second regulation portion may be connected to the third regulation portion by a connection portion that is spaced from the circumference surface of the development sleeve by an interval that is gradually narrowed toward the third regulation portion.

Where A is an interval between a front end portion of the third regulation portion in the rotational direction of the development sleeve and the circumference surface of the development sleeve, B is an interval between a back end portion of the third regulation portion in the rotational direction of the development sleeve and the circumference surface of the development sleeve, and C is an interval between the second regulation portion and the circumference surface of the development sleeve, the following ranges may apply: 2 mm≤A≤8 mm, 0.5 mm≤B≤4 mm, and 1 mm≤C≤7 mm.

According to another aspect, there is provided an image forming apparatus including the development device described above.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

The present general inventive concept will now be described more fully with reference to the accompanying drawings, in which exemplary embodiments of the present general inventive concept are shown.

Figure 1:
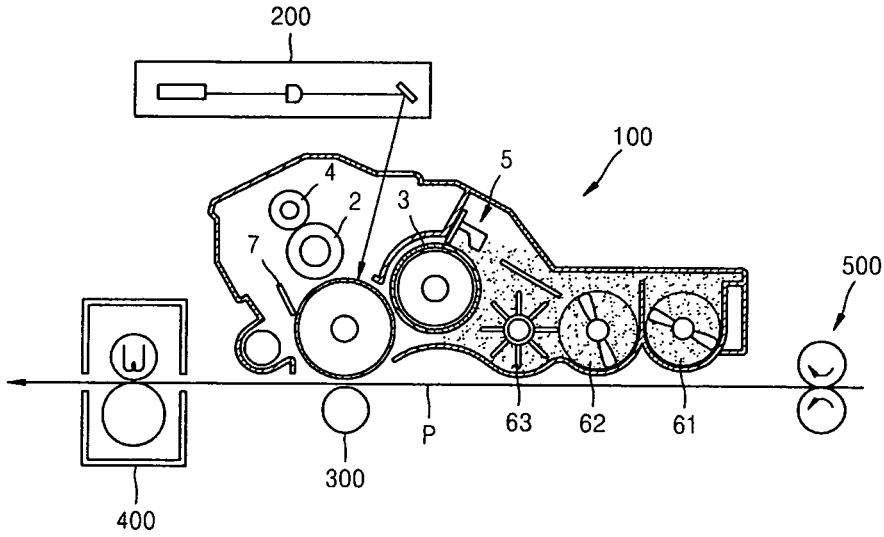
FIG. 1 is a view of an image forming apparatus according to an embodiment.
Figure 2:
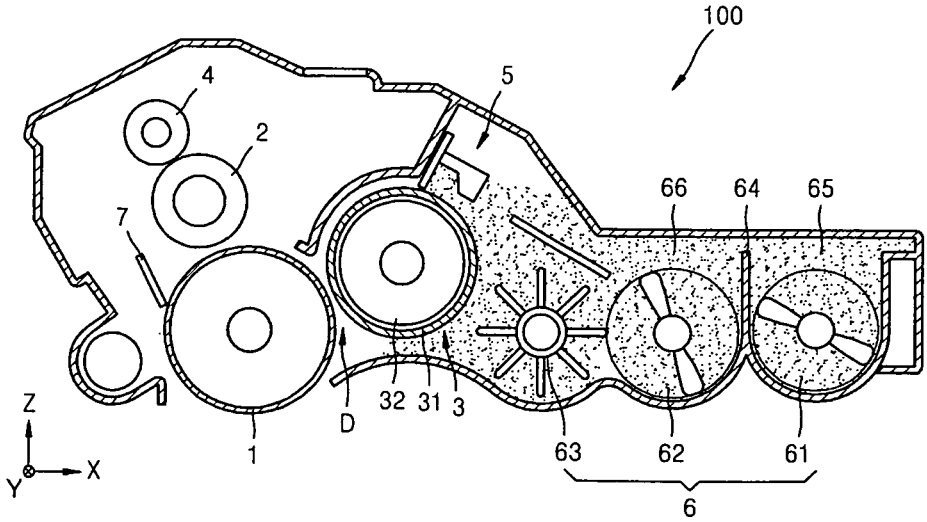
FIG. 2 is a view of a development device according to an embodiment.

FIG. 1 is a view of an image forming apparatus according to an embodiment, and FIG. 2 is a view of a development device 100 according to an embodiment included in the image forming apparatus of FIG. 1. The development device 100 according to the present embodiment is one body-type development device which includes a photo-sensitive drum 1 and a development roller 3.

Referring to FIGS. 1 and 2, the photo-sensitive drum 1 is an example of a photo receptor on which an electrostatic latent image is formed. The photo-sensitive drum 1 may be a cylindrical metallic pipe on which a photo-sensitive layer that is photo-conductive is formed. A charge roller 2 is an example of a charger for charging a surface of the photo-sensitive drum 1 with a uniform charge. A charge bias is applied to the charge roller 2. A corona charger (not shown) may be used instead of the charge roller 2. A cleaning roller 4 is an example of a charge roller cleaning member for removing a foreign material attached to a circumference of the charge roller 2. A cleaning member 7 is used to remove a residual toner and a foreign material from the surface of the photo-sensitive drum 1 before the photo-sensitive drum 1 is charged. The cleaning member 7 may be, for example, a cleaning blade having an end directly contacting the surface of the photo-sensitive drum 1.

The development roller 3 delivers a developing agent and supplies the developing agent to an electrostatic latent image formed on the surface of the photo-sensitive drum 1. In the present embodiment, the developing agent used in the development device 100 is a two-component developing agent including a toner and a carrier. The carrier is attached to a circumference surface of the development roller 3 due to a magnetic force of the development roller 3. The toner is attached to the carrier due to an electrostatic force. Thus, a developing agent layer including the toner and the carrier is formed in a magnetic brush-shape on the circumference surface of the development roller 3. By rotation of the development roller 3, the developing agent layer may be delivered to a development region D in which the photo-sensitive drum 1 faces the development roller 3. Due to a development bias applied to the development roller 3, the toner is separated from the developing agent layer and moves onto the electrostatic latent image formed on the photo-sensitive drum 1.

A regulation portion 5 regulates an amount of the developing agent supplied to the development region D. For example, the regulation portion 5 may be spaced apart from the circumference surface of the development roller 3 and regulates a thickness of the developing agent layer.

The development device 100 may include a supply unit 6 for supplying the developing agent to the development roller 3. The supply unit 6 may agitate the toner and the carrier so as to charge the toner with a given charge potential. Referring to FIG. 2, the development device 100 according to the present embodiment includes, as the supply unit 6, two agitators 61 and 62 and a paddle 63. A barrier rib 64 may be formed between the agitators 61 and 62. Although not illustrated in FIGS. 1 and 2, a passage may be located at ends of the barrier rib 64 in a Y direction. For example, the agitator 61 allows the developing agent to move in a +Y direction and the agitator 62 allows the developing agent to move in a −Y direction. Due to the structure described above, the developing agent circulates in regions 65 and 66 divided from each other by the barrier rib 64, and during the circulation, the carrier and the toner are agitated to charge the toner with a given charge potential. The developing agent delivered in the −Y direction by the agitator 62 is delivered to the development roller 3 by the paddle 63. However, the structure of the supply unit 6 illustrated in FIG. 2 is an example and the present general inventive concept is not limited thereto. For example, the agitator 62 may not be used. Alternatively, the paddle 63 is not used, the agitator 62 may be disposed where the paddle 63 is currently located and the agitator 61 may be disposed where the agitator 62 is currently located. Alternatively, only one agitator may be disposed where the paddle 63 is currently located. The structure of the supply unit 6 may differ according to a size or type of a region assigned for accommodating the developing agent in the development device 100.

Figure 3:
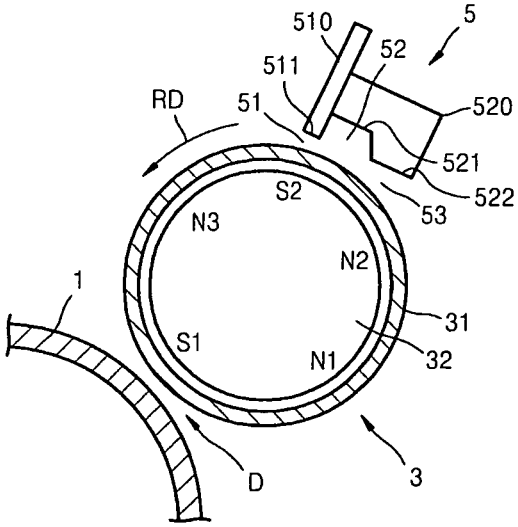
FIG. 3 is a view of an example of a development roller and a regulation portion.

FIG. 3 is a sectional view of an example of the development roller 3. The development roller 3 may include a development sleeve 31 that is rotatable and a magnetic roller 32 located inside the development sleeve 31. The magnetic roller 32 is used to attach the carrier to a circumference surface of the development sleeve 31 via a magnetic force. Due to the magnetic force of the magnetic roller 32, the carrier is attached to the circumference surface of the development sleeve 31 and the toner is attached to the carrier due to an electrostatic force. The magnetic roller 32 may be fixedly disposed inside the development sleeve 31. The magnetic roller 32 may have a plurality of magnetic poles. In the present embodiment, the magnetic roller 32 have a main pole S1, a separation pole N1, a catch pole N2, a regulation pole S2, and a transporting pole N3 sequentially located in the stated order from the development region D in a rotational direction of the development sleeve 31. Due to a magnetic force of the catch pole N1, a developing agent layer may be formed in a magnetic brush-shape on the circumference surface of the development sleeve 31. The catch pole N1, the regulation pole S2, the transporting pole N3, and the main pole S1 are an N pole, an S pole, an N pole, and an S pole, respectively. The separation pole N1 and the catch pole N2 are N poles. Accordingly, magnetic forces of the separation pole N1 and the catch pole N2 repel each other and thus the developing agent is separated from the circumference surface of the development sleeve 31. Then, the separated developing agent is mixed with new developing agent and the mixture is supplied to the catch pole N2 by the paddle 63. The structure of the magnetic roller 32 is an example and the present general inventive concept is not limited thereto.

Referring to FIG. 1, an exposure device 200 scans on the surface of the photo-sensitive drum 1 charged with a uniform charge potential a light L that is modified according to image information. The exposure device 200 may be, for example, a laser scanning unit (LSU) that polarizes light irradiated from a laser diode by using a polygon mirror in a main scan direction and scans the polarized light on the photo-sensitive drum 1.

A transfer roller 300 is an example of a transfer device, and is disposed facing the surface of the photo-sensitive drum 1 and forms a transfer nip. A transfer bias is applied to the transfer roller 300 so as to transfer a toner image developed on the surface of the photo-sensitive drum 1 onto a recording medium P. The transfer roller 300 may be replaced with a corona transfer device.

The toner image transferred onto a surface of the recording medium P by the transfer roller 300 remains on the surface of the recording medium P due to an electrostatic attractive force. A fixing device 400 applies heat and pressure to the toner image to fix the toner image on the recording medium P, thereby forming a permanent printed image on the recording medium P.

An image forming process will now be described briefly using the structure described above. A charge bias is applied to the charge roller 2 and the photo-sensitive drum 1 is charged with a uniform charge potential. The exposure device 200 scans a light that is modified according to image information to the photo-sensitive drum 1 in order to form an electrostatic latent image on the surface of the photo-sensitive drum 1. The developing agent is attached to the circumference surface of the development roller 3 in a magnetic brush-shape, thereby forming a developing agent layer. A thickness of the developing agent layer is regulated by the regulation portion 5 and the developing agent layer is delivered to the development region D. Due to a development bias applied to the development roller 3, the toner is separated from the developing agent layer and moves onto an electrostatic latent image formed on the surface of the photo-sensitive drum 1. The toner is attached to the electrostatic latent image to form a visible toner image on the surface of the photo-sensitive drum 1. The recording medium P output from a loading member (not shown) is transferred to the transfer nip at which the transfer roller 300 faces the photo-sensitive drum 1 by a transfer roller 500. When a transfer bias is applied to the transfer roller 300, the toner image is transferred onto the recording medium P due to an electrostatic attractive force. The toner image transferred onto the recording medium P is heated and pressurized by the fixing device 400 and thus fixed on the recording medium P, thereby completing the printing process. The residual toner not transferred to the recording medium P and remaining on the surface of the photo-sensitive drum 1 is removed by the cleaning member 7.

Hereinafter, the regulation portion 5 for forming a uniform developing agent layer on the circumference surface of the development roller 3 will be described in detail.

Figure 4:
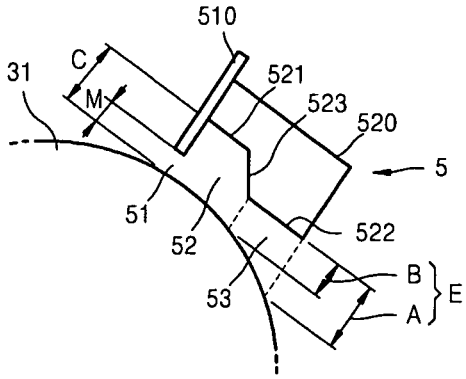
FIG. 4 is a detailed view of the regulation portion of FIG. 3.

Referring to FIGS. 3 and 4, the regulation portion 5 may include first, second, and third regulation portions 51, 52, 53 respectively spaced apart from the circumference surface of the development roller 31 by a first interval M, a second interval C, and a third interval E. The first, second, and third regulation portions 51, 52, and 53 are sequentially disposed in the stated order in an opposite direction to a rotational direction RD of the development sleeve 31.

The first regulation portion 51 may be defined by, for example, a doctor blade 510 with an end 511 spaced apart from the circumference surface of the development sleeve 31 by the first interval M. The doctor blade 510 may be a metal plate, such as a stainless iron plate or an aluminum plate, or a plastic plate. The first interval M may be set in consideration of an interval between the circumference surface of the development sleeve 31 and the surface of the photo-sensitive drum 1 in the development region D. For example, the first interval M may be in the range of about 0.2 to 1.5 mm. The first interval M may be defined as a shortest distance between the circumference surface of the development sleeve 31 and the end 511 of the doctor blade 510.

The second interval C may be greater than the third interval E. The third interval E may be narrowed in the rotational direction RD of the development sleeve 31. That is, with reference to the rotational direction RD of the development sleeve 31, a front interval A of the third regulation portion 53 is greater than a back interval B.

According to the structure described above, a pressure (a first developing agent pressure) applied to the developing agent in the first regulation portion 51 may be greater than a pressure (a second developing agent pressure) applied to the developing agent in the second regulation portion 52. In addition, the second developing agent pressure is smaller than a pressure (a third developing agent pressure) applied to the developing agent in the third regulation portion 53. The first developing agent pressure is a pressure that is applied to terminally regulate an amount of the developing agent. By setting the third developing agent pressure high, an amount change of the developing agent supplied to the regulation portion 5 by the supply unit 6 with respect to a pressure change of the supplied developing agent, that is, an amount change of the developing agent passing through the first regulation portion 51 with respect to a pressure change of the supplied developing agent, may be reduced. In addition, by setting the second developing agent pressure to be lower than the third developing agent pressure, a stress applied to the developing agent may be reduced. Moreover, although the third developing agent pressure increases in the rotational direction RD of the development sleeve 31, the pressure applied to the developing agent that circulates in the second regulation portion 52 and passes back through the third regulation portion 53 is rather decreased. Accordingly, the developing agent circulated to the third regulation portion 53 from the second regulation portion 52 may easily pass back through the third regulation portion 53 due to the gradually decreasing third developing agent pressure.

For example, the second and third regulation portions 52 and 53 may be formed using by a sub blade 520 that is located prior to the doctor blade 510 in the rotational direction RD of the development sleeve 31. The sub blade 520 may include a first surface 521 spaced apart from the circumference surface of the development sleeve 31 by the second interval C and a second surface 522 spaced apart from the circumference surface of the development sleeve 31 by the third interval E. With reference to the rotational direction RD of the development sleeve 31, the front interval A by which a front portion of the second surface 522 is spaced apart from the circumference surface of the development sleeve 31 may be greater than the back interval B by which a back portion of the second surface 522 is spaced apart from the circumference surface of the development sleeve 31. The sub blade 520 may be, for example, a plastic plate or a metal plate.

Figure 5:
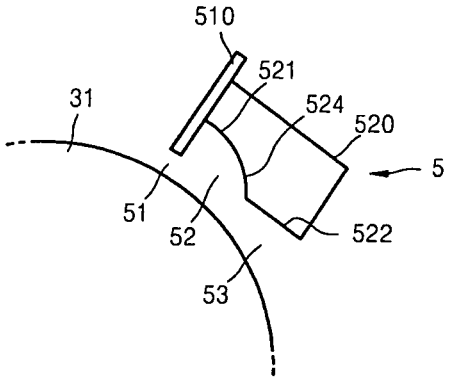
FIG. 5 is a view of a modified example of the regulation portion of FIG. 3.

The second regulation portion 52 may be connected to the third regulation portion 53 by a connection portion that is spaced apart from the circumference surface of the development sleeve 31 by an interval gradually narrowing toward the third regulation portion 53. Referring to FIG. 4, the connection portion may be an inclination portion 523 connecting the first surface 521 to the second surface 522. Alternatively, the connection portion may instead be a curved portion 524 connecting the first surface 521 to the second surface 522 as illustrated in FIG. 5. In this regard, the curved portion 524 may be concave toward the development sleeve 31 outside the development sleeve 31. In addition, although not illustrated in the figures used herein, the second regulation portion 52 and the connection portion may be embodied as one curved portion that is concave toward the development sleeve 31 outside the development sleeve 31.

The regulation portion 5 including the first, second, and third regulation portions 51, 52, and 53 is not limited to the present embodiment and may have any structure as long as the above-described conditions are satisfied. For example, the first, second, and third regulation portions 51, 52, and 53 may be embodied as one member formed by integrating the doctor blade 510 and the sub blade 520.

Figure 6:
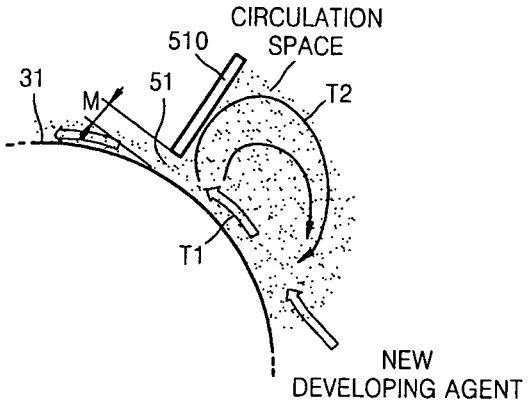
FIG. 6 is a view to explain a behavior of a developing agent regulated by a regulation portion including only a first regulation portion.

Referring to FIG. 6, a behavior of the developing agent regulated by the first regulation portion 51 when the second and third regulation portions 52 and 53 are not used and only the first regulation portion 51 is used, that is, when only the doctor blade 510 illustrated in FIG. 3 is used, will now be described in detail. A developing agent layer formed on the circumference surface of the development sleeve 31 due to the magnetic force of the magnetic roller 32 moves to the first regulation portion 51 in a direction indicated by an arrow T1 by rotation of the development sleeve 31. Since the first regulation portion 51 is spaced apart from the circumference surface of the development sleeve 31 by the first interval M, only a portion of the developing agent layer passes through the first regulation portion 51 and is supplied to the development region D. The remaining developing agent is blocked by the doctor blade 510. After the blocked developing agent collides with the doctor blade 510, the developing agent gathers in a circulation space. In this regard, when the circulation space is too large, the developing agent may not circulate and may be trapped in the circulation space and stayed therein in a direction indicated by an arrow T2. That is, the developing agent blocked by the doctor blade 510 is not mixed with new developing agent supplied to the circulation space by the supply unit 6 and stays in the circulation space while moving around the circulation space. A pressure caused by the staying developing agent in the circulation space may hinder the supply of the developing agent to the first regulation portion 51. In addition, due to a magnetic absorption force of the developing agent staying in the circulation space, the developing agent may not smoothly pass through the first regulation portion 51. As described above, when an amount of the developing agent supplied to the development region D is not uniform or insufficient, an image concentration may be non-uniform or lowered. Moreover, if there is a large circulation space, the pressure change of the developing agent supplied to the first regulation portion 51 may greatly affect the image concentration, and thus, the image concentration may be non-uniform according to a rotational cycle of the supply unit 6 for supplying the developing agent to the development sleeve 31. That is, the image concentration may be changed according to a periodic change of the amount of the developing agent supplied by the supply unit 6.

Figure 7:
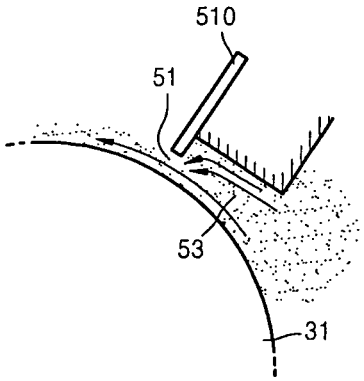
FIG. 7 is a view to explain a behavior of a developing agent regulated by a regulation portion including a first regulation portion and a third regulation portion.
Figure 8:
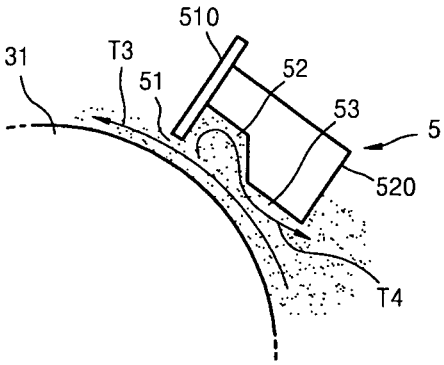
FIG. 8 is a view to explain a behavior of a developing agent regulated by a regulation portion including first, second, and third regulation portions.

By referring to FIG. 7, a behavior of the developing agent regulated by the first regulation portion 51 and the third regulation portion 53 will now be described in detail. In this case, since the third regulation portion 53 causes a certain degree of pressure on the developing agent prior to the first regulation portion 51, formation of a non-uniform image concentration according to a rotational cycle of the supply unit 6 for supplying the developing agent to the development sleeve 31 may be prevented, although in a limited way. However, the developing agent does not circulate in the third regulation portion 53 and the pressure on the developing agent in the third regulation portion 53 is continuously increased. Accordingly, a stress applied to the developing agent in the third regulation portion 53 is increased and a lifetime of the developing agent may be reduced. In addition, when a foreign material is mixed with the developing agent, the foreign material may fit through the first regulation portion 51 and thus a printing defect in a strip pattern may occur. Moreover, the pressure on the developing agent in the third regulation portion 53 is so high that the developing agent may not be smoothly supplied, and a rotation load of the development sleeve 31 may be increased.

In the regulation portion 5 according to the present embodiment, the second regulation portion 52 is located prior to the first regulation portion 51 in the rotational direction RD of the development sleeve 31 so as to limit the circulation space of the developing agent blocked by the first regulation portion 51. As a result, movement of the developing agent only in the circulation space as illustrated in FIG. 6 may be prevented. In addition, by locating the third regulation portion 53 causing the third developing agent pressure, which is greater than the second developing agent pressure, prior to the second regulation portion 52 in the rotational direction RD of the development sleeve 31, the formation of a non-uniform image concentration according to the rotational cycle of the supply unit 6 may be prevented. Referring to FIGS. 3, 4, 5, and 8, due to the catch pole N2, the developing agent layer formed by attachment of the carrier and the toner to the development sleeve 31 enters the third regulation portion 53 by rotation of the development sleeve 31. Since the third interval between the third regulation portion 53 and the circumference surface of the development sleeve 31 is gradually narrowed in the rotational direction RD of the development sleeve 31, the pressure on the developing agent in the third regulation portion 53 is gradually increased. Subsequently, when the developing agent reaches the second regulation portion 52 spaced apart from the circumference surface of the development sleeve 31 by the second interval C, which is greater than the third interval B, the pressure on the developing agent is reduced. Accordingly, the stress applied to the developing agent may be reduced. In addition, since the pressure on the developing agent in the third regulation portion 53 is maintained, the non-uniform supply of the developing agent according to the rotational cycle of the supply unit 6 may less affect the amount of the developing agent passing through the first regulation portion 51. While the development sleeve 31 continuously rotates, some of the developing agent attached to the circumference surface of the development sleeve 31 may pass through the first regulation portion 51 in a direction indicated by an arrow T3 and may be supplied to the development region D.

The developing agent blocked by the doctor blade 510 circulates along the first surface 521 and the connection portion (inclination portion 523 or curve portion 524) in the second regulation portion 52 and passes through the third regulation portion 53 in a direction indicated by an arrow T4. In such a structure in which the second regulation portion 52 is connected to the third regulation portion 53 by the inclination portion 523 or the curve portion 524, the blocked developing agent is easily induced to move toward the third regulation portion 53 and the developing agent may easily circulate. In addition, with respect to the developing agent passing back through the third regulation portion 53, the developing agent pressure of the third regulation portion 53, that is, the third developing agent pressure, is gradually reduced in the passing back direction. Thus, the developing agent circulated in the second regulation portion 52 and entered into the third regulation portion 53 may easily pass back through the third regulation portion 53. In addition, a possibility of discharging a foreign material that is mixed with the developing agent in the circulation process out of the regulation portion 5 may be increased. In addition, since a magnetic absorption force of the developing agent may be limited by controlling the size of the circulation space, a limitation on the amount of the developing agent passing through the first regulation portion 51 due to a magnetic absorption force of the developing agent in the circulation space may be overcome. The smooth circulation of the developing agent in the second regulation portion 52 may be effective for reducing the stress applied to the developing agent in the first regulation portion 51.

Figure 9:
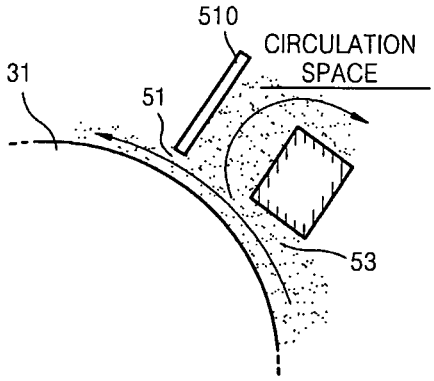
FIG. 9 is a view to explain a behavior of a developing agent regulated by a regulation portion with an unconfined circulation space.

As illustrated in FIG. 9, when the circulation space is not limited, the pressure on the developing agent in the circulation space may be too low and thus it may be difficult to supply an appropriate amount of the developing agent to the first regulation portion 51. By limiting the size of the circulation space via the second regulation portion 52, the pressure on the developing agent in the second regulation portion 52 may be controlled to supply an appropriate amount of the developing agent to the first regulation portion 51.

According to experiments, the second interval C and the third interval E may be set in the following ranges.

In regard to the front interval A, 2 mm≤A≤8 mm. When A is in this range, the developing agent may be easily supplied to the first regulation portion 51 and the developing agent blocked by the first regulation portion 51 may be easily discharged.

In regard to the back interval B, A>B and 0.5 mm≤B≤4 mm. When B is in this range, the pressure on the developing agent in the third regulation portion 53 may be maintained at an appropriate level.

In regard to the interval C, C>B and 1 mm≤C≤7 mm. When C is in this range, the developing agent may smoothly circulate in the second regulation portion 52 and also the pressure on the developing agent in the second regulation portion 52 may be maintained at an appropriate level.

Figure 10:
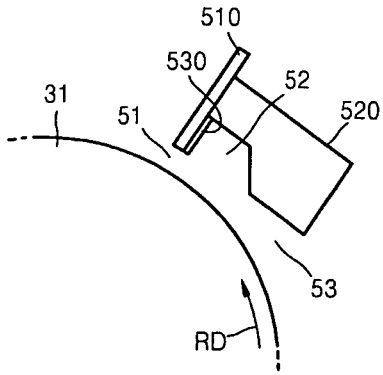
FIG. 10 is a view of a regulation portion including a magnetic member as another modified example of the regulation portion of FIG. 3.

The wider an interval between the first regulation portion 51 and the circumference surface of the development sleeve 31 is, that is, the greater the first interval M is, the less stress may be applied to the developing agent and thus the lifetime of the developing agent may be increased. However, when the first interval M is too wide, an excessive amount of the developing agent may be supplied to the development region D. As a method for increasing the first interval M while maintaining the amount of the developing agent passing through the first regulation portion 51 at an appropriate level, application of a magnetic load in the first regulation portion 51 may be taken into consideration. Referring to FIG. 10, with reference to the rotational direction RD of the development sleeve 31, a magnetic member 530 may be located prior to the first regulation portion 51. Since the carrier contained in the two-component developing agent is a magnetic carrier, a magnetic force of the magnetic member 530 may act as a load on the developing agent passing through the first interval M. Accordingly, when the magnetic member 530 is used, the first interval M may be formed wider than when the magnetic member 530 is not used, while the amount of the developing agent passing through the first interval M is the same.

Figure 11:
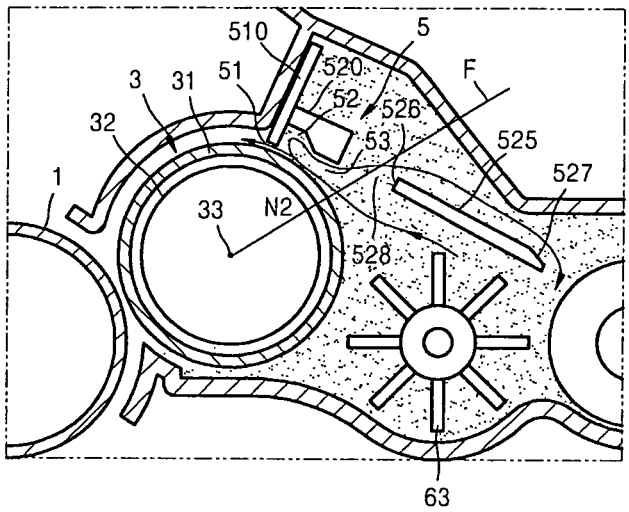
FIG. 11 is a view of a development device according to another embodiment, including a guiding member to guide to a supply unit a developing agent that circulated in a regulation portion and moved out of the regulation portion.

The developing agent circulated in the opposite direction to the rotational direction RD of the development sleeve 31 according to the circulation process described above and discharged from the regulation portion 5 is already affected by a certain degree of stress during the circulation. Thus, instead of directly entering into the regulation portion 5, the developing agent needs to be mixed with new developing agent and then enters the regulation portion 5. Referring to FIG. 11, the development device 100 according to the present invention may further include a developing agent guide member 525. An end 526 of the developing agent guide member 525 may be spaced from the third regulation portion 53 and another end 527 of the developing agent guide member 525 extends over the supply unit 6. The end 527 of the developing agent guide member 525 may extend passing a center of a member of the supply unit 6 closest to the development roller 3 among members of the supply unit 6, that is, the center of the paddle 63 in FIG. 11. The developing agent discharged from the third regulation portion 53 according to the circulation process in the regulation portion 5 passes an interval 528 between the front end of the third regulation portion 53 in the rotational direction RD of the development sleeve 31 and the end 526 of the developing agent guide member 525, moves along the developing agent guide member 525, and passes the paddle 63. Accordingly, the discharged developing agent is newly charged with an appropriate potential by agitation by the agitator 62, and mixed with new developing agent and supplied to the regulation portion 5 by the paddle 63.

The developing agent discharged from the third regulation portion 53 collides with the developing agent supplied to the third regulation portion 53 by the paddle 63, passes through the interval 528, and is guided to the developing agent guide member 525. In order to guide the developing agent discharged from third regulation portion 53 to easily move to the developing agent guide member 525 through the interval 528, the end 526 of the developing agent guide member 525 may be disposed farther from the third regulation portion 53 than a line F passing a center 33 of the development roller 3 and the catch pole N2. Since the developing agent located near the catch pole N2 may form a developing agent layer with a magnetic brush shape due to a magnetic force of the catch pole N2, the developing agent discharged from the third regulation portion 53 is blocked by the magnetic brush and does not move toward the paddle 63 and is easily guided to the developing agent guide member 525.

Figure 12:
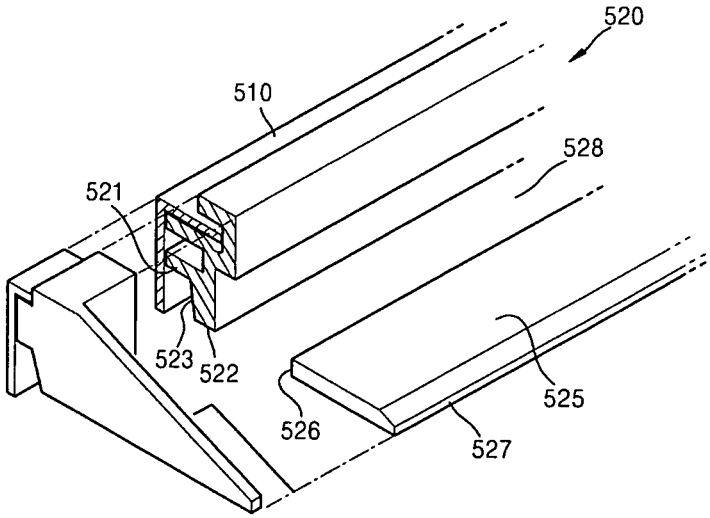
FIG. 12 is a perspective view of an example of first, second, and third regulation portions.

For example, the second and third regulation portions 52 and 53 and the developing agent guide member 525 may be embodied as the sub blade 520 as illustrated in FIG. 12.

According to a development device according to an embodiment of the present general inventive concept and an image forming apparatus including the development device, the following effects may be obtained.

First, by guiding a developing agent blocked by a first regulation portion to circulate outside a regulation portion, a decrease in fluidity of the developing agent due to the developing agent staying in the regulation portion, an increase in a stress applied to the developing agent, a decrease in image concentration due to the problems described above, and a non-uniform image concentration may be prevented. In addition, since a foreign material mixed with the developing agent is able to be discharged outside the regulation portion, a supply interruption of the developing agent by the foreign material may be prevented.

Second, since a third regulation portion is disposed spaced from a circumference surface of a development sleeve by an interval that is narrowed in a rotational direction of the development sleeve, a non-uniform supply of the developing agent according to a rotational cycle of a supply unit may less affect an amount of the developing agent supplied to a development region.

Third, by widening a regulation region prior to a first regulation portion for terminally regulating the developing agent, uniformity of a developing agent layer on a development roller may be obtained and a load on the developing agent due to the first regulation portion may be reduced.

Fourth, since a second regulation portion limits a circulation space of the developing agent and makes a pressure on the developing agent to be lower than that on the developing agent in the third regulation portion, the developing agent may be smoothly supplied to the first regulation portion and a stress applied to the developing agent may be reduced.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A development device using a developing agent comprising a toner and a carrier, the development device comprising:

a development roller that attaches the developing agent to a circumference surface of the development roller and transfers the developing agent to a development region in which the development roller faces a photo receptor; and a regulation portion to regulate an amount of the developing agent transferred to the development region, wherein the regulation portion comprises first, second, and third regulation portions sequentially disposed in the stated order in an opposite direction to a rotational direction of the development roller, the first, second, and third regulation portions are respectively spaced apart from the circumference surface of the development roller by first, second, and third intervals, the second interval is greater than the third interval, and the third interval is narrowed in the rotational direction of the development roller, wherein the first regulation portion forms a first developing agent pressure, the second regulation portion forms a second developing agent pressure that is smaller than the first developing agent pressure, and the third regulation portion forms a third developing agent pressure that is greater than the second developing agent pressure, wherein the second regulation portion forms a circulation space to allow the developing agent blocked by the first regulation portion to be discharged from the regulation portion through the third regulation portion outside the regulation portion, wherein A>B and C>B, where A is an interval between a front end portion of the third regulation portion in the rotational direction of the development roller and the circumference surface of the development roller, B is an interval between a back end portion of the third regulation portion in the rotational direction of the development roller and the circumference surface of the development roller, and C is the second interval, and wherein 2 mm≤A≤8 mm, 0.5 mm≤B≤4 mm, and 1 mm≤C≤7 mm.

2. The development device of claim 1, wherein the second regulation portion is connected to the third regulation portion by a connection portion that is spaced from the circumference surface of the development roller by an interval that is narrowed toward the third regulation portion.

3. The development device of claim 2, wherein the connection portion is an inclination portion.

4. The development device of claim 2, wherein the connection portion is a curved portion that is concave toward the circumference surface of the development roller.

5. The development device of claim 2, wherein the second regulation portion and the connection portion constitute a curved portion that is concave toward the circumference surface of the development roller.

6. The development device of claim 1, further comprising:

a supply unit comprising at least one member to supply the developing agent to the development roller; and a developing agent guide member that has an end spaced apart from the third regulation portion and extends from the end over a member of the supply unit closest to the development roller among the members of the supply unit.

7. The development device of claim 6, wherein the development roller comprises a development sleeve that is rotatable and a magnetic roller that is fixedly disposed inside the development sleeve, the magnetic roller comprises a catch pole that attaches the developing agent to the development sleeve, and the end of the developing agent guide member is disposed farther from the third regulation portion than a line passing a center of the development roller and the catch pole.

8. The development device of claim 7, wherein the developing agent guide member extends over a center of the member of the supply unit closest to the development roller among the members of the supply unit.

9. The development device of claim 1, wherein a magnetic member is disposed between the first regulation portion and the second regulation portion and applies a magnetic load to a developing agent layer formed on the circumference surface of the development roller.

10. An image forming apparatus comprising the development device of claim 1.

11. The image forming apparatus of claim 10, wherein the second regulation portion is connected to the third regulation portion by a connection portion that is spaced from the circumference surface of the development roller by an interval that is narrowed toward the third regulation portion.

12. The image forming apparatus of claim 10, further comprising:

a supply unit comprising at least one member to supply the developing agent to the development roller; and a developing agent guide member that has an end spaced apart from the third regulation portion and extends from the end over a member of the supply unit closest to the development roller among the members of the supply unit.

13. The image forming apparatus of claim 12, wherein the development roller comprises a development sleeve that is rotatable and a magnetic roller that is fixedly disposed inside the development sleeve, the magnetic roller comprises a catch pole that attaches the developing agent to the development sleeve, and the end of the developing agent guide member is disposed farther from the third regulation portion than a line passing a center of the development roller and the catch pole.

14. The image forming apparatus of claim 13, wherein the developing agent guide member extends over a center of the member of the supply unit closest to the development roller among the members of the supply unit.

15. The image forming apparatus of claim 10, wherein a magnetic member is disposed between the first regulation portion and the second regulation portion and applies a magnetic load to a developing agent layer formed on the circumference surface of the development roller.

16. A development device comprising:

a development sleeve that is rotatable;

a magnetic roller that is fixedly disposed inside the development sleeve and forms a developing agent layer comprising a carrier and a toner in a magnetic brush shape on a circumference surface of the development sleeve;

a doctor blade having an end that is spaced apart from the circumference surface of the development sleeve by a first interval, thereby forming a first regulation portion; and a sub blade that is disposed prior to the doctor blade in a rotational direction of the development sleeve, wherein the sub blade comprises a first surface that is spaced apart from the circumference surface of the development sleeve by a second interval that is greater than the first interval, thereby forming a circulation space for a developing agent that does not pass the first interval, and a second surface that is spaced apart from the circumference surface of the development sleeve by a third interval that is smaller than the second interval, thereby forming a passage for the developing agent supplied to the circulation space and the developing agent discharged from the circulation space, wherein the sub blade comprises a developing agent guide member that has an end spaced apart from a front end portion of the second surface in the rotational direction of the development sleeve so as to allow the developing agent discharged through the passage for the developing agent to pass therethrough and extends from the end over the supply unit so that the developing agent discharged through the passage for the developing agent is collected by the supply unit, wherein A>B, C>B, 2 mm≤A≤8 mm, 0.5 mm≤B≤4 mm, and 1 mm≤C≤7 mm, and wherein A is an interval between the front end portion of the second surface in the rotational direction of the development sleeve and the circumference surface of the development sleeve, B is an interval between a back end portion of the second surface in the rotational direction of the development sleeve and the circumference surface of the development sleeve, and C is the second interval.

17. The development device of claim 16, wherein the development device further comprises a supply unit comprising at least one member for supplying the developing agent to the development sleeve.

18. The development device of claim 17, wherein the magnetic roller comprises a catch pole that attaches the developing agent to the development sleeve, and the end of the developing agent guide member is disposed farther from the front end portion of the second surface in the rotational direction of the development sleeve than a line passing a center of the development sleeve and the catch pole and the developing agent guide member extends over a center of a member of the supply unit closest to the development sleeve among members of the supply unit.

19. The development device of claim 18, wherein the first surface is connected to the second surface by a connection portion that is spaced apart from the development sleeve by an interval that is gradually narrowed.

20. The development device of claim 19, wherein an interval between the second surface and the circumference surface of the development sleeve is gradually narrowed in the rotational direction of the development sleeve.

21. A development device comprising:

a development sleeve that is rotatable;

a magnetic roller that is fixedly disposed inside the development sleeve and forms a developing agent layer comprising a carrier and a toner in a magnetic brush-shape on a circumference surface of the development sleeve; and a regulation portion that is spaced apart from the circumference surface of the development sleeve and regulates a thickness of a developing agent layer attached to the circumference surface of the development sleeve, wherein the regulation portion comprises first, second, and third regulation portions sequentially disposed in the stated order in an opposite direction to a rotational direction of the development sleeve, wherein the first regulation portion forms a first developing agent pressure, the second regulation portion forms a second developing agent pressure that is smaller than the first developing agent pressure, and the third regulation portion forms a third developing agent pressure that is greater than the second developing agent pressure, wherein the second regulation portion forms a circulation space to allow a developing agent blocked by the first regulation portion to be discharged from the regulation portion through the third regulation portion, wherein A>B and C>B, where A is an interval between a front end portion of the third regulation portion in the rotational direction of the development roller and the circumference surface of the development roller, B is an interval between a back end portion of the third regulation portion in the rotational direction of the development roller and the circumference surface of the development roller, and C is the second interval, and wherein 2 mm≤A≤8 mm, 0.5 mm≤B≤4 mm, and 1 mm≤C≤7 mm.

22. The development device of claim 21, wherein the third developing agent pressure is gradually increased in the rotational direction of the development sleeve.

23. The development device of claim 22, wherein an interval between the third regulation portion and the circumference surface of the development sleeve is gradually decreased in the rotational direction of the development sleeve, an interval between the second regulation portion and the circumference surface of the development sleeve is greater than the interval between the third regulation portion and the circumference surface of the development sleeve, and the second regulation portion is connected to the third regulation portion by a connection portion that is spaced from the circumference surface of the development sleeve by an interval that is gradually narrowed toward the third regulation portion.

* * * * *